US005577275A

United States Patent [19]

Guenther

[11] Patent Number: 5,577,275

[45] Date of Patent: Nov. 26, 1996

[54] TUB/SHOWER GRAB BAR

[75] Inventor: Torbett B. Guenther, 8992 Tamarack Ct., Plymouth, Mich. 48170

[73] Assignees: Torbett B. Guenther; Dolores Guenther, both of Plymouth, Mich.

[21] Appl. No.: 442,688

[22] Filed: May 17, 1995

[51] Int. Cl.[6] ..... A47K 3/12

[52] U.S. Cl. ..... 4/576.1; 4/611; 211/105.1

[58] Field of Search ..... 4/559, 576.1, 577.1, 4/608, 610, 611; 211/105.1; 248/251

[56] References Cited

U.S. PATENT DOCUMENTS

| | | | |
|---|---|---|---|
| 1,147,348 | 7/1915 | Wadsworth | 4/577.1 |
| 1,367,290 | 2/1921 | Williams | 211/105.1 |
| 1,725,802 | 8/1929 | Hoegger | 4/576.1 |
| 2,199,851 | 5/1940 | Culver . | |
| 3,633,862 | 1/1972 | Breen | 248/251 |

FOREIGN PATENT DOCUMENTS

| | | | |
|---|---|---|---|
| 1049997 | 3/1979 | Canada | 4/576.1 |
| 0198100 | 5/1923 | United Kingdom | 211/105.1 |
| 0630411 | 10/1949 | United Kingdom | 4/577.1 |

*Primary Examiner*—Robert M. Fetsuga

*Attorney, Agent, or Firm*—Barnes, Kisselle, Raisch Choate, Whittemore & Hulbert, P.C.

[57] ABSTRACT

A grab bar assembly for installation into openings in opposed wall sections of a tub/shower wall that includes a cup-shaped pocket having one end for receipt into one of the wall section openings and a second open end with a radially outwardly projecting flange for engaging an opposing surface of the wall section surrounding the opening. A grab bar has a closed first end slidably received into the pocket. The second end of the grab bar is received into the second wall surface opening, and has a radially outwardly projecting flange for abutment with an opposing surface of the wall sections surrounding the second opening. A screw adjustably extends through the first end of the pocket into abutment with the closed end of the grab bar, so that the grab bar is captured in compression between the pocket and associated screw at one end, and the radially extending flange at the other.

12 Claims, 2 Drawing Sheets

TUB/SHOWER GRAB BAR

The present invention is directed to grab bars for installation between opposed wall section openings of a tub or shower wall.

BACKGROUND AND OBJECTS OF THE INVENTION

Grab bars of the subject character are conventionally disposed in recesses or Dockets in a tub/shower wall to assist entry into and egress from the tub/shower, and otherwise to aid the tub/shower occupant in maintaining balance. Such grab bars conventionally comprise a metal tube that extends through aligned sidewall openings in the wall recess. Beads of silicon or other suitable sealant are formed around the outside ends of the bar at the exterior surfaces of the opposed wall sections to hold the bar in position and seal against seepage of water from the tub/shower. Pins may be inserted through the opposed ends of the bar for abutting the outside surface of the main tub/shower wall to help prevent rotation of the bar during use. Such a grab bar assembly, including particularly the seals, is expensive and time-consuming to assemble, and is subject to failure during use.

It is therefore a general object of the present invention to provide a grab bar of the subject character that is economical to manufacture, and that may be readily and economically installed during tub/shower installation. Another object of the present invention is to provide a grab bar of the described character that may be readily colored to match the color of the tub/shower wall.

SUMMARY OF THE INVENTION

A grab bar assembly for installation into openings in opposed wall sections of a tub/shower wall in accordance with one presently preferred embodiment of the invention includes a cup-shaped pocket having one end for receipt into one of the wall section openings and a second open end with a radially outwardly projecting flange for engaging an opposing surface of the wall section surrounding the opening. A grab bar has a closed first end slidably received into the first pocket. The second end of the grab bar is received into the second wall surface opening, and has a radially outwardly projecting flange for abutment with an opposing surface of the wall section surrounding the second opening. A screw adjustably extends through the first end of the first pocket into abutment with the closed end of the grab bar, so that the grab bar is captured in compression between the first pocket and associated screw at one end, and the radially extending flange at the other.

The flange at the second end of the grab bar may be formed integrally with the grab bar, or may comprise a second cup-shaped pocket into which the second end of the grab bar is slidably received. The grab bar in the preferred embodiments of the invention is formed by a blow-molded or injection-molded plastic sleeve having an interior metal reinforcing tube. Alternatively, the grab bar may be of solid molded plastic composition. The exterior of the molded plastic grab bar may be readily colored to match the color of the tub/shower into which the grab bar is to be installed.

In a second embodiment of the invention, the grab bar assembly comprises a molded hollow plastic tube having a flange integrally radiating from one end and exterior threads at the other. A hollow metal reinforcing tube is disposed within the plastic sleeve. The plastic sleeve extends between and through the openings in the opposed wall sections of the tub/shower wall, and a plastic nut is threaded onto the threaded end of the grab bar to capture the same in assembly.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
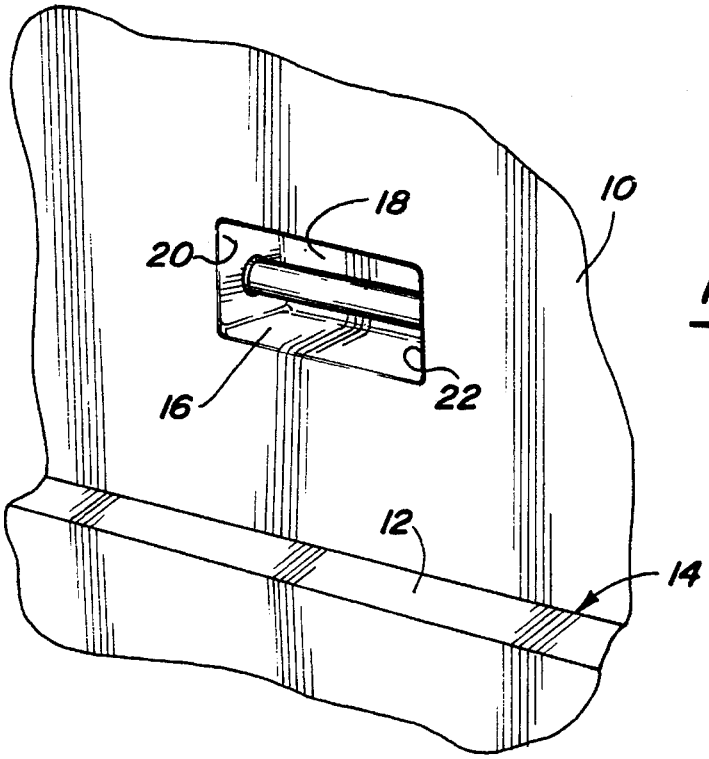
FIG. 1 is a fragmentary perspective view of a tub/shower installation having a grab bar installed in accordance with one embodiment of the present invention.

FIG. 1 illustrates a pre-formed tub/shower wall 10 positioned adjacent to the rim 12 of a tub 14. A grab bar 16 is installed in a recess 18 in tub/shower wall 10 above rim 12 of tub 14. Specifically, grab bar 16 extends between opposed wall sections 20,22 of recess 18, generally horizontally and parallel to rim 12 of tub 14.

Figure 2:
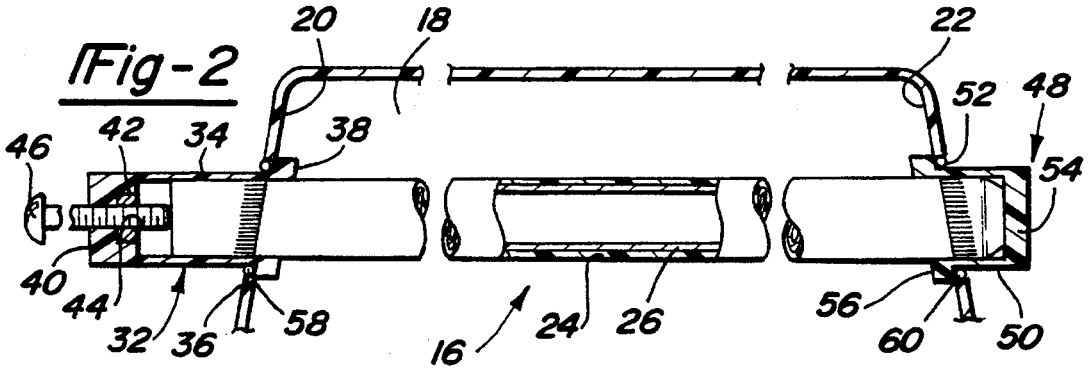
FIG. 2 is a fragmentary plan sectional view of the grab bar installation illustrated in FIG. 1.

Referring to FIG. 2, grab bar 16 comprises a hollow sleeve 24 of injection-molded or blow-molded hollow plastic tubular construction. A hollow metal tube 26 is telescopically received within plastic sleeve 24. End caps 28,30 of molded plastic or other suitable composition are telescopically received within the opposed ends of reinforcing tube 26. A first hollow cup-shaped pocket 32 has a cylindrical body 34 received within a pre-formed opening 36 in wall section 20, and an integral radially outwardly projecting flange 38 that abuts the opposing exterior surface of wall section 20. The end or base 40 of pocket 32 carries an internally threaded nut 42 aligned with a central through-opening 44. A screw 46 extends through opening 44 and is threadably received within nut 42.

A second pocket 48 has a cylindrical body 50 telescopically received within an opening 52 in opposing wall section 22. The base 54 of pocket 48 is closed. A flange 56 projects radially outwardly from body 50 to engage the opposing exterior wall surface of wall section 22. Pockets 32,48 preferably are of molded plastic composition, and of a color to match the exterior color of grab 16 and/or the color of tub/shower wall 10. Nut 42 may be insert-molded into base 40 of pocket 32, or may be secured by adhesive to pocket 32 in an after-molding operation. Annular channels are formed in the under-surfaces of flanges 38,56 to receive respective elastomeric O-rings 58,60 for enhanced sealing engagement with the opposing wall surfaces.

In assembly, circular openings 36,52 are first formed coaxially with each other in wall sections 20,22 of pocket 18 in tub/shower wall 10. This may be accomplished at the time of manufacture or, more preferably, during installation. Screw 46 is backed out of nut 42 so that the end of grab bar 16 may be fully inserted into pocket 32. With pocket 48 assembled to the opposing end of the grab bar, pocket 32 is then inserted into opening 36 in wall section 20. The overall length of the grab bar and pockets is such that, with screw 46 fully backed out, grab bar 16 and pocket 48 may be swung into position so that pocket 48 may be inserted into opening 32 in wall section 22. Screw 46 is then threaded into nut 42. The end of screw 46 engages end cap 28 on reinforcing tube 26, and thereby urges reinforcing tube 26 and outer sleeve 24 against the base of opposing pocket 48. Thus, the grab bar is captured in compression between pocket 48 and screw 46 in pocket 32, and flanges 38,56 with underlying O-rings 58,60 are in firm sealing engagement with the opposing tub/shower wall surfaces. Pocket 48 preferably has angulated interior dogs that cooperate with notches 62 in end cap 30 to help prevent rotation of the grab bar during use. The exterior surface of the grab bar may be either smooth or serrated for enhanced gripping action.

Figure 3:
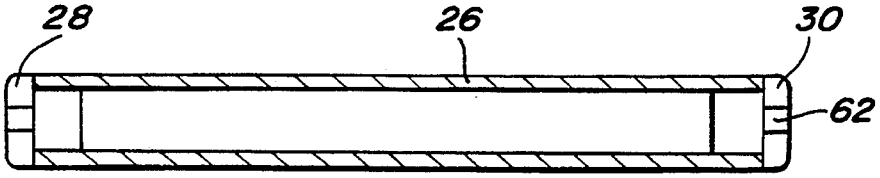
FIG. 3 is a sectional view of the grab bar reinforcing tube employed in the assembly of FIG. 2.
Figure 4:
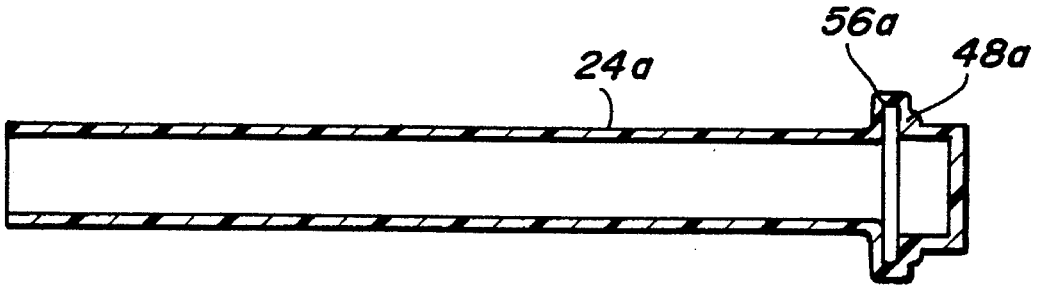
FIG. 4 is a sectional view of an alternative grab bar sleeve to that illustrated in FIG. 2.

FIG. 4 illustrates a modification to the embodiment of FIGS. 2–3, in which molded plastic grab bar sleeve 24 and pocket 48 in FIG. 2 are replaced by a molded plastic grab bar sleeve **24*a* with integral pocket/flange element 48*a* in FIG. 4—i.e., sleeve 24*a* and element 48*a* are of one-piece monolithic composition. That is, the radially extending flange 56*a* is formed integrally with grab bar sleeve 24*a* with an extension formed by element 48*a* for insertion into opening 52 in wall section 22 (FIG. 1). There is no need for an end cap 30 in the reinforcing tube 26. Otherwise, a grab bar employing sleeve 24*a* in FIG. 4 would be the same as illustrated in FIGS. 2 and 3**.

Figure 5:
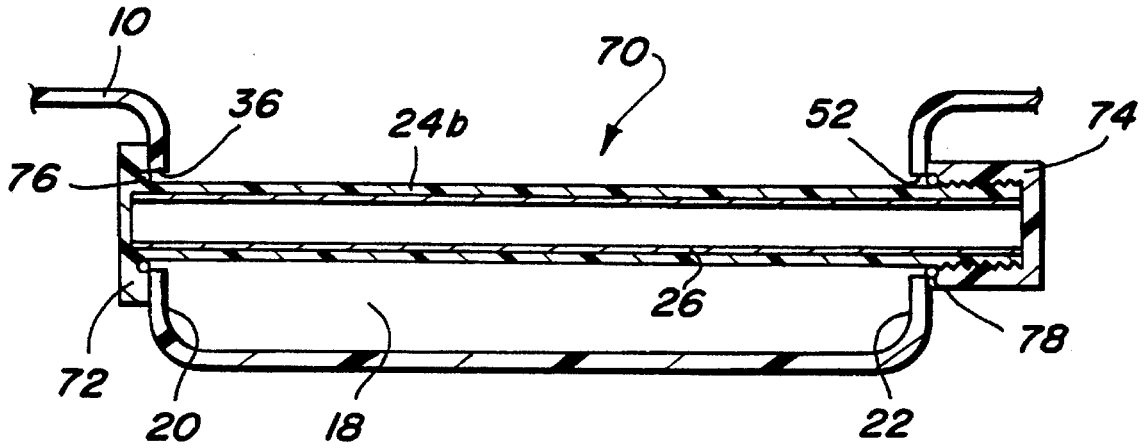
FIG. 5 is a fragmentary sectional view of a grab bar installation in accordance with a modified embodiment of the invention.

FIG. 5 illustrates a modified grab bar 70, which comprises a hollow plastic sleeve **24*b* having a flange 72 integrally molded at one end and exterior threads formed at the opposing end. A metal reinforcing tube 26 is received within sleeve 24*b*. Sleeve 24*b* with interior reinforcing tube 26 is inserted through opening 36 of wall section 20 and across recess 18 through opening 52 in wall section 22. Flange 72 exteriorly abuts the opposing surface of wall section 20. A plastic nut 74 is received on the threaded end of tube 24*b*, and snugly abuts the opposing exterior surface of wall section 22. O-rings 76,78 are respectively disposed beneath flange 72 and beneath nut 74 for enhanced sealing engagement with wall sections 20,22**.

I claim:

1. A grab bar arrangement for installation into openings in opposed wall sections of a tub/shower wall, said grab bar arrangement comprising:

a first cup-shaped pocket having a first end for receipt into a first of the openings and a second open end with a first radially outwardly projecting flange for engaging an opposing surface of the wall section surrounding the first opening, means for adjustably extending through said first end of said first pocket, a grab bar having first and second ends, said first end being closed and adapted to be received into said first pocket for abutting said adjustably extending means, and means at the second end of said grab bar for receipt into the second wall opening, including a second radially outwardly projecting flange for abutment with an opposing surface of said wall section surrounding said second opening.

2. The grab bar arrangement set forth in claim 1 wherein said first end of said first pocket has a threaded opening, and wherein said adjustably extending means comprises threaded means for extending through said threaded opening.

3. The grab bar arrangement set forth in claim 2 wherein said first pocket including said flange is of one-piece monolithic integral plastic composition, and wherein said threaded opening is formed by an internally threaded member affixed to said first end of said first pocket.

4. The grab bar arrangement set forth in claim 3 wherein said member is insert molded into said first end of said first pocket.

5. The grab bar arrangement set forth in claim 1 wherein at least a portion of said grab bar is of plastic composition.

6. The grab bar arrangement set forth in claim 5 wherein said grab bar comprises a hollow plastic sleeve.

7. The grab bar arrangement set forth in claim 6 wherein said grab bar comprises a hollow metal reinforcing tube disposed within said hollow plastic sleeve.

8. The grab bar arrangement set forth in claim 5 wherein said means at said second end of said grab bar, including said second flange, is molded integrally with said grab bar.

9. The grab bar arrangement set forth in claim 1 wherein said means at said second end of said grab bar comprises a second cup-shaped pocket having a base for receipt into the second wall opening, said second radially extending flange being integral with said second cup-shaped pocket.

10. The grab bar arrangement set forth in claim 9 further comprising opposed means at said second end of said grab bar for engaging said second pocket and preventing rotation of said second end of said grab bar with respect to said second pocket.

11. The grab bar arrangement set forth in claim 1 further comprising sealing means for disposition beneath said first and second flanges to seal said flanges against the opposing surfaces of said wall sections.

12. The grab bar arrangement set forth in claim 11 wherein said sealing means comprise O-rings.

* * * * *